United States Patent [19]

Johnson

[11] 4,195,492

[45] Apr. 1, 1980

[54] SAFETY EARRINGS FOR PIERCED EARS

[76] Inventor: Gordon A. Johnson, 817 Sir Francis Ave., Capitola, Calif. 95010

[21] Appl. No.: 833,869

[22] Filed: Sep. 16, 1977

[51] Int. Cl.[2] ..... A44C 7/00

[52] U.S. Cl. ..... 63/12; 63/11; 63/29 R; 63/29 M

[58] Field of Search ..... 63/12, 13, 29

[56] References Cited

U.S. PATENT DOCUMENTS

| | | | |
|---|---|---|---|
| 119,530 | 10/1871 | Northrup | 63/12 |
| 216,954 | 7/1879 | Heckmann | 63/12 |
| 320,991 | 6/1885 | Westcott | 63/12 |
| 3,504,507 | 4/1970 | Ferro | 63/12 |
| 3,630,048 | 12/1971 | Masters | 63/12 |
| 3,698,044 | 10/1972 | Chernow | 63/12 X |
| 3,890,800 | 6/1975 | Montague | 63/13 |
| 3,910,065 | 10/1975 | Holt | 63/12 |
| 3,945,089 | 3/1976 | Gagnon | 63/12 X |
| 4,139,993 | 2/1979 | Tucker | 63/12 |

FOREIGN PATENT DOCUMENTS

| | | | |
|---|---|---|---|
| 796714 | 6/1958 | United Kingdom | 63/29 R |

*Primary Examiner*—F. Barry Shay

[57] ABSTRACT

A post to extend through the pierced hole in an ear lobe. One end of the post has a stop that is positioned against one surface of the ear lobe. The opposite end of the post has a small male snap connector portion. A smooth and flat back with a small female snap connector portion therein is snapped on the post against the other surface of the ear lobe to retain the post in the pierced hole, but if the post or the back is pulled, the back automatically releases from the post to prevent injury to the ear lobe. The back has a barrier that prevents the post from passing completely through the back. The stop has and the back may have a connector portion for attaching interchangeable ornaments. When worn with no ornament attached, the earring is essentially nonsnaggy. Interchangeable ornaments are provided with mating connector portions to hold the ornament to the post during normal activity but whenever an ornament is pulled, to automatically release the ornament from the post to prevent injury to the ear lobe. The back's end of the post may be pointed for use with an ear piercing machine to pierce ears.

20 Claims, 9 Drawing Figures

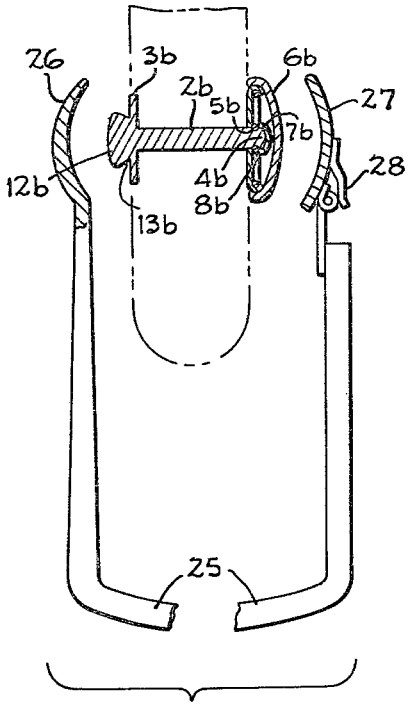
FIG. 4
FIG. 6
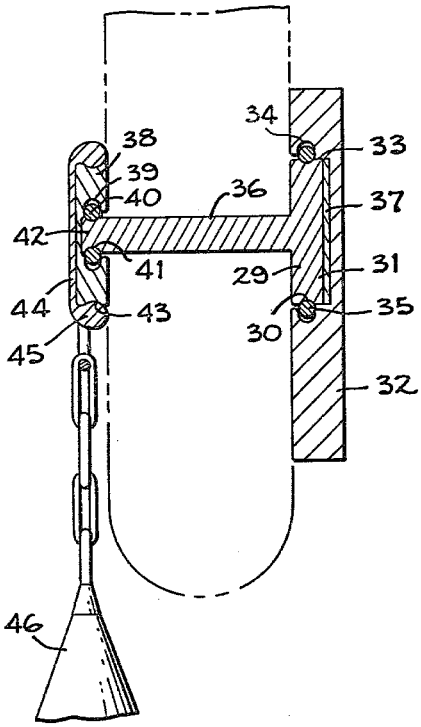
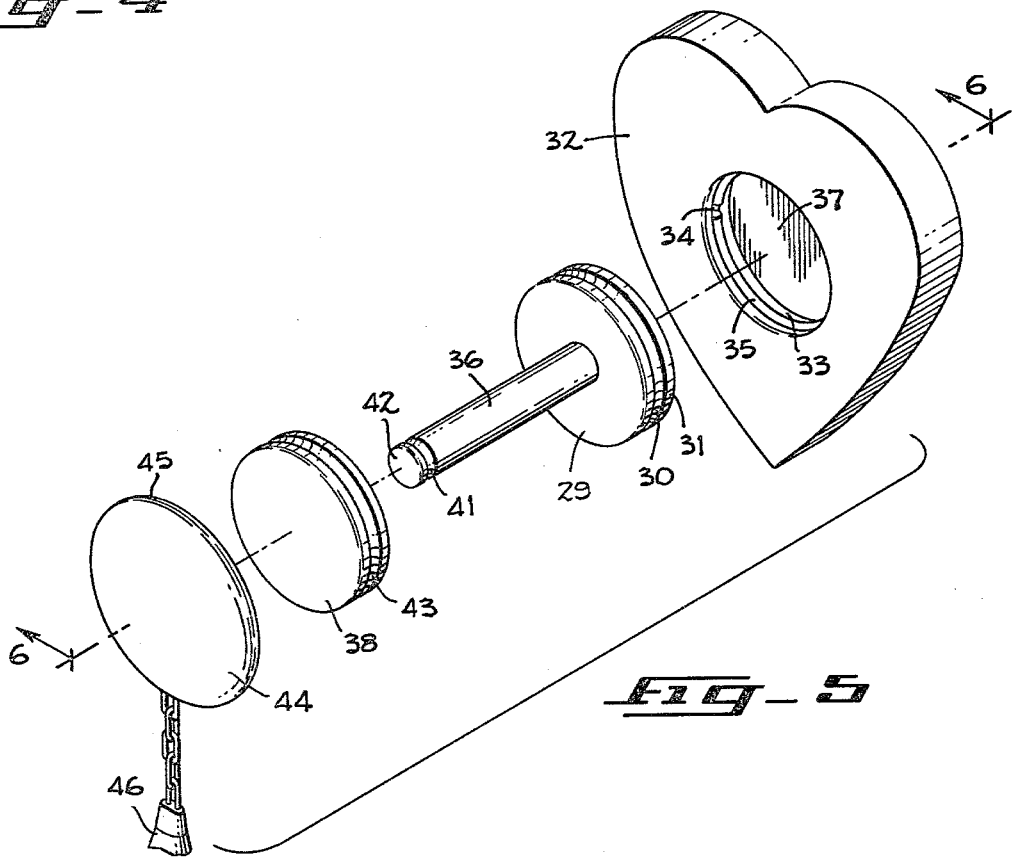
FIG. 5

Fig_7
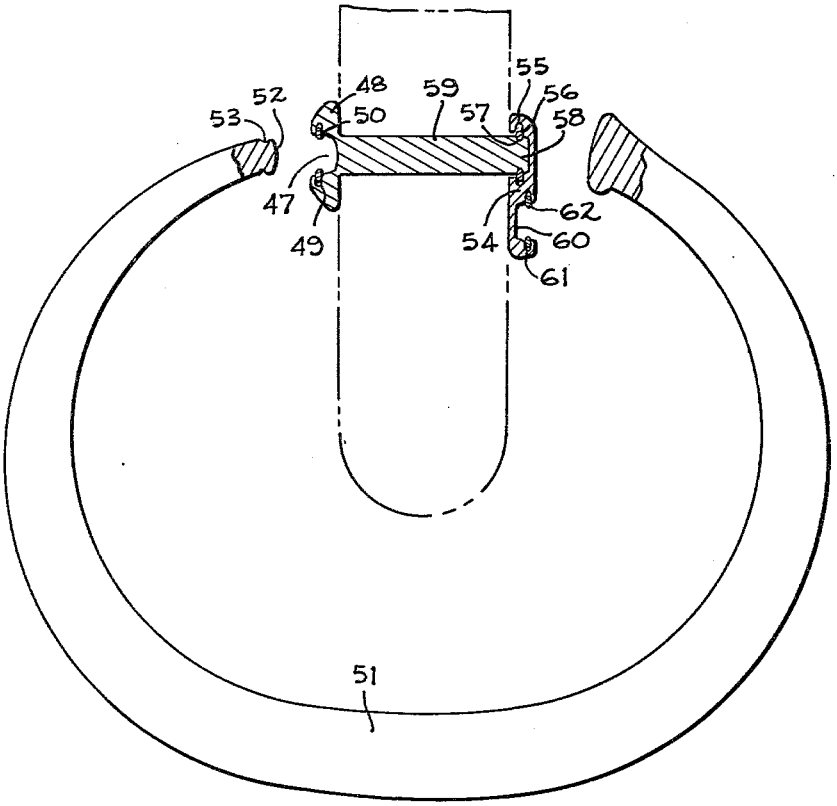
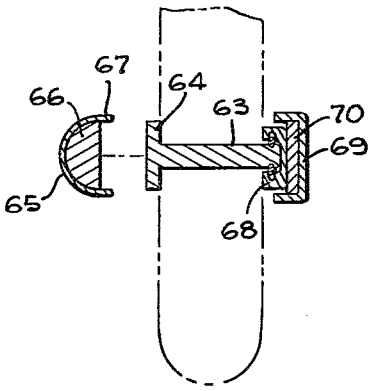
Fig_8
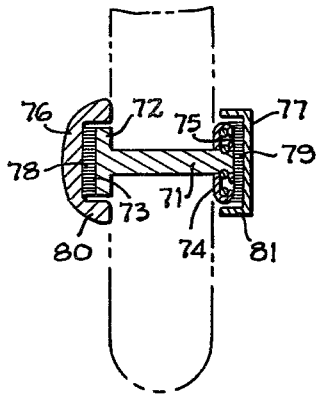
Fig_9

SAFETY EARRINGS FOR PIERCED EARS

BACKGROUND OF THE INVENTION

1. Field of the Invention

The present invention relates generally to ornamental jewelry and particularly to post type safety earrings with interchangeable ornaments.

2. Description of the Prior Art

There are many kinds of nonpierced earrings that clamp on the ear lobe. An earring that clamps onto the ear lobe must be secured tightly or it could easily be lost by just dropping off without the wearer being aware of it; and if secured tightly, it pinches and hurts the ear lobe.

Pierced earrings have been worn by people of many different cultures for thousands of years, and they are the most popular type of earring. The weight of heavy ornaments hanging from bent wire hook or loop types of pierced earrings causes the bottom of the edges of the pierced holes in the ear lobes to be permanently torn down and have a slit shape.

Numerous earrings with straight posts have been provided in the past, some of which include interchangeable ornamentation that require removing the post from the ear lobe in order to change ornaments. Removing and reinserting pierced earrings in order to change ornaments is undesirable because the pierced hole tends to reclose and there is always the danger of scratching the ear lobe, which may cause serious infection and which may distort the shape of the pierced hole.

Most important is the danger of partial or complete tearing of the ear lobe if an ornament or any other part of a pierced earring is accidentally snagged. Babies often grab and pull earring ornaments. Earring ornaments can also be pulled in many other ways, for instance if someone or something brushes against the side of the wearer's head. Such accidents happen frequently and cause the part of the pierced earring that extends through the pierced hole to cut and tear the ear lobe. Such injuries are painful and may cause serious infection and permanent disfigurement of the ear lobe. There is also a danger with ornaments that look expensive of a thief viciously snatching the ornaments and tearing the ear lobes.

Whenever the words "pull" or "pulled" are used in this application and in the claims, reference is made to a force being exerted in a direction away from the ear lobe and away from the portion of the earring post that normally rests in the pierced hole in the ear lobe and the force causes sufficient tension along the portion of the post that normally rests in the pierced hole to seriously cut and/or tear the ear lobe if a part of the earring were not to automatically release to eliminate the tension. The term "excessive tension" has been used in the claims to refer to a degree of tension which would caues injury to the ear if not relieved. The words "push" or "pushed" refer in this application and in the claims to a force being exerted toward the ear lobe and toward the portion of the earring post that normally rests in the pierced hole and the force would tend to compress the portion of the post that normally rests in the pierced hole if the portion of the post that normally rests in the pierced hole were compressible.

To retain the post in the pierced hole, most post type earrings have a push-on back, which is a back that is pushed on and along the rear end of the post outside the ear lobe until the push-on back contacts the rear surface of the ear lobe. The post usually can protrude through the push-on back and the post usually does protrude through the push on back. The protruding end of the post very frequently pokes and scratches the wearer. The wearer's lover also can be scratched by the end of a post that protrudes through a push-on back. Furthermore, the end of a post that protrudes through a push-on back can be snagged, for instance in clothing, and cause the ear lobe to be torn.

Push-on backs of the prior art have elongated sides that extend along the length of the post. To secure a push-on back on a post, the elongated sides of the push-on back are clasped between the thumb and a finger of one hand, while the other hand holds the front of the post. The push-on back is then pushed on and along the rear end of the post until the push-on back contacts the rear surface of the ear lobe. The thumb and the finger can thereby pass over and along the rear end of the post that protrudes through the push-on back without being poked by the end of the post. However, these elongated sides result in the push-on back protruding too far from the rear surface of the ear lobe and result in the wearer being exposed to too great of a risk that the push-on back will be snagged and cause the ear lobe to be torn.

It is difficult to position a push-on back of the prior art at just the correct place on the post. If the push-on back is not pushed on the post far enough, the push-on back may drop off during normal activity and then the pierced earring may slide out of the pierced hole and be lost. If the push-on back is pushed on the post far enough so that the push-on back won't just drop off during normal activity, it may nevertheless not be pushed on the post far enough to keep the front ornament against the front surface of the ear lobe and an unsightly gap between the ornament and the front surface of the ear lobe will result. And if the push-on back is pushed on too tightly, it will pinch the ear lobe, which will begin to hurt after awhile. During the wearing of earrings with push-on backs, the wearer usually has to check the push-on back's position and make any required adjustments.

To secure the push-on back to the post, the push-on back of the prior art must be pushed along the post an undesirably long distance; and in addition, the push-on back usually must be pushed along the post even further until the push-on back contacts the rear surface of the ear lobe. When a push-on back is snagged and pulled or when the front of the earring is snagged and pulled, the push-on back has an undesirably long distance to be forced before the post is free of the push-on back, and this undesirable resistance from the push-on back is dangerous because it increases the risk of the ear lobe being seriously injured. To accommodate push-on backs and to accommodate ear lobes of all sizes, posts of the prior art are longer than necessary. The longer the post, the less likely it is that the post will slide out of the pierced hole without tearing the ear lobe if the front of the earring is snagged and pulled. And the longer the post, the more likely it is that the rear of the earring will be snagged and pulled and cause the ear lobe to be torn.

Another problem in the prior art with post type earrings and with push-on backs occurs when one end of the earring is pushed, which causes the other end of the earring to be pressed against the side of the wearer's head. A gentle way such pushing from both the front and the rear can occur is when the wearer's head moves on a pillow during sleep. Even such light pressure can cause the earring to poke, scratch and irritate the side of the head if the front and/or the rear of the earring protrudes too far from the ear lobe, especially if the front and/or the rear of the earring contains any slender, jutting and rigid projections.

The pierced earring with interchangeable ornaments disclosed in the U.S. Pat. to Northup, No. 119,530, uses loops which are useful with only a limited variety of ornaments and which offer no protection when the ornament is snagged and pulled.

Interchangeable ornamentation is disclosed in the U.S. Pat. to Ferro, No. 3,504,507. It provides for an earring post with a back that can't be detached from the post and for the post to be inserted into the pierced hole from the rear. One variation of the front end provides for ornaments with a screw thread that screw on the post, and no protection is provided when the ornament is snagged and pulled. The other variation provides for ornaments with a pair of substantially parallel flat springs which project from the ornament and which extend along the length of the front end of the post and clamp against opposite sides of the post. There is nothing to retain the post in the ear lobe without an ornament attached. Therefore, the post must be removed before washing hair, going to bed or doing any other activity in which an ornament would likely be pulled.

Other pierced earrings of the prior art with ornaments that release whenever the ornament is pulled are nevertheless dangerous because such earrings have snaggy hooks, loops, prongs or claws on which ornaments attach; and even when the ornament easily releases when pulled or even if the earring is worn without an ornament attached, the remaining part of the pierced earring is snaggy and thus likely to get caught in or on something and be pulled and cause the ear lobe to be torn.

The best method of piercing ears is with an ear piercing machine. It is superior to the old method in which a needle is poked through the ear lobe by hand and then an earring is inserted by hand. The ear piercing machine inserts a sterilized surgical steel or gold piercing post into the ear lobe, and the piercing post should normally never be removed from the ear lobe for about six weeks after the ear lobe is newly pierced to allow the wound to heal properly and a hole to form properly. The machine method makes holes that are straighter, rounder, smoother and big enough. The machine method is quicker, easier, less painful and less bloody. The machine method greatly reduces the risk of infection. There are no posts in the prior art that can be used in an ear piercing machine to pierce ears and that also have interchangeable front ornaments that automatically release from the post whenever the ornament is pulled.

SUMMARY OF THE PRESENT INVENTION

It is therefore an object of the present invention to provide an improved pierced earring that is free of the above described and other disadvantages of the prior art.

The main object of the present invention is to provide a safer pierced earring.

The most important advantage of the present invention is that it provides adequate protection to prevent the pierced earring from tearing, cutting, scratching and pinching the ear lobe of the wearer.

Another advantage of the present invention is the earring may be safely and comfortably worn without an ornament attached; and when so worn, adequate protection is provided to prevent the earring from being snagged and pulled, from irritating the side of the wearer's head, and from scratching the wearer or another.

Another advantage of the present invention is that interchangeable earring ornaments of almost every design can very easily be connected to the post and disconnected from the post without removing the post from the pierced hole and without looking in a mirror.

Another advantage of the present invention is that the post may safely and comfortably remain in the pierced hole continuously for several months without at any time being removed from the pierced hole.

An additional advantage of the present invention is that the post may be used with an ear piercing machine to pierce ears.

In summary, the objects and advantages are achieved with a post-type earring. The post is straight and round, is properly made of surgical steel or other hypo-allergenic material and extends through the pierced hole in an ear lobe.

One end of the post has a small, relatively flat, circular stop that stops the post from passing completely through the pierced hole. The side of the stop that has the post has a flat and smooth surface around the post, has the post in the center thereof, is at right angles to the post, is properly made of surgical steel or other hypo-allergenic material, has a diameter sufficient to prevent the stop from entering the pierced hole and is positioned flat against one surface of the ear lobe. The opposite side of the stop, the exposed side, has a connector portion so that interchangeable ornaments may be connected to and disconnected from the post. The exposed side of the stop and the stop's connector portion may be made of any suitable material and may be ornamental in appearance. Various embodiments provide that the connector portion is half of a snap, magnetic and/or Velcro connector and/or is one half of the receiving half of a clamp connector.

When the stop is in position flat against the surface of the ear lobe, the stop and the stop's connector portion protrude less than three millimeters from the surface of the ear lobe, have no slender, jutting and rigid projections, have no exposed sharp points or edges that could cut or snag, have nothing that is likely to be accidentally caught in or on anything and be pulled and have a surface and contour that is sufficiently smooth and even to avert snagging. Therefore, the stop and the stop's connector portion are essentially nonsnaggy when in position against one surface of the ear lobe in order to prevent injury to the ear lobe.

The opposite end of the post is slightly rounded and has a small groove around the post next to the slightly rounded end, and is a small male snap connector portion. The post is of such length that the small male snap connector portion can just pass completely through the pierced hole.

To safely retain the post in the pierced hole, the present invention also provides a novel and original back, a snap-on back. The snap-on back is small, circular and relatively flat and has a female snap connector portion within the snap-on back that snaps on the small male snap connector portion on the end of the post to securely hold the snap-on back to the post during normal activity. If the end of the post that has the stop is pulled and/or if the snap-on back is pulled, the snap-on back automatically releases from the post to prevent injury to the ear lobe.

One side of the snap-on back has the entrance of the female snap connector portion in its center, has a substantially flat and smooth surface around the entrance, is properly made of surgical steel or other hypo-allergenic material, has a diameter sufficient to prevent the snap-on back from entering the pierced hole and is positioned flat against the other surface of the ear lobe to retain the post in the pierced hole when the snap-on back is attached.

The opposite side of the snap-on back, the exposed side, has a smooth, solid and relatively flat surface, and may be made of gold, silver, surgical steel, plastic or other material. The exposed side of the snap-on back and/or the rear of the female snap connector portion includes a barrier that prevents the end of the post from protruding through the snap-on back. Also the barrier does not allow the snap-on back to be pushed along the post further than the very short distance that is required to secure the snap-on back to the small male snap connector portion at the end of the post. Furthermore, the earring can't pinch the ear lobe because the barrier also prevents the snap-on back from being pushed too tightly against the ear lobe.

The snap-on back can very easily be snapped on the small male snap connector portion at the end of the post by placing the exposed side of the snap-on back against the thumb. A finger of the same hand presses against the other side of the snap-on back, the side that is to be positioned against the surface of the ear lobe, to hold the snap-on back while it is being brought to the end of the post. The other hand holds the stop's end of the post. When the female snap connector portion within the snap-on back is over the small male snap connector portion at the end of the post, the finger slides out of the way and the thumb pushes harder and snaps the snap-on back on the end of the post. The end of the post can not protrude through the snap-on back and poke the thumb. Also the position of the snap-on back on the post does not need to be adjusted after the snap-on back is snapped on. Consequently, the snap-on back does not need elongated sides that extend along the length of the post to hold when securing the snap-on back on the post, and the snap-on back does not have such elongated sides. Therefore, the snap-on back does not protrude far from the surface of the ear lobe.

The exposed side of the snap-on back may also have a connector portion for ornaments so that interchangeable ornaments may be connected to and disconnected from the snap-on back. Various embodiments provide that the connector portion is half of a snap, magnetic and/or Velcro connector and/or is the other half of the receiving half of a clamp connector.

When the snap-on back is in position flat against the surface of the ear lobe, the snap-on back, even if it is a snap-on back with a connector portion for ornaments, protrudes less than three millimeters from the surface of the ear lobe, has no slender, jutting and rigid projection, has no exposed sharp point or edge that could cut or snag, has nothing that is likely to be accidentally caught in or on anything and be pulled and has a surface and contour that is sufficiently smooth and even to avert snagging. Therefore, to prevent injury to the wearer, both the basic snap-on back and the snap-on back with a connector portion for ornaments are essentially nonsnaggy when in position against the surface of the ear lobe.

When worn without an ornament attached, the exposed parts of the earring are of minimal size, are sufficiently nonprotrusive from both the front and the rear surfaces of the ear lobe and are sufficiently smooth and even so that there is substantially no possibility of the earring being accidentally snagged and pulled. The wearer is therefore free from the danger of the earring being snagged and pulled when the earring is worn without an ornament attached; and the wearer is free from the danger of further snagging and pulling when the earring is worn with an ornament attached and the ornament is caught in or on something and pulled off. The earring not only provides adequate protection to prevent the ear lobe from being cut and/or torn, but when worn with no ornament attached, it also provides adequate protection to prevent the earring from injuring and/or irritating the side of the wearer's head, and from scratching the wearer or another.

Interchangeable ornaments of almost every design are provided. Each ornament has a mating connector portion so the ornament can very easily be connected to and disconnected from the post without removing the post from the pierced hole and without looking in a mirror. It is much easier and safer to connect an ornament to the post of the present invention than it is to insert any pierced earring into a pierced hole and secure it in the ear lobe. Various embodiments provide that the ornament's connector portion is the mating half of the snap, magnetic and/or Velcro connector and/or is the clamp half of the clamp connector that clamps against both the stop's and the snap-on back's connector portions at the same time. The connectors securely hold the ornament to the post during normal activity, but whenever the ornament is pulled, the ornament automatically releases from the post to prevent injury to the ear lobe.

Thus, whenever an ornament is pulled, the present invention provides double protection. Usually the ornament automatically releases from the post to prevent injury to the ear lobe, but the snap-on back may automatically release first to prevent injury to the ear lobe. Whenever it says in this application and in the claims that the ornament automatically releases from the post whenever the ornament is pulled, it means, of course, that the ornament automatically releases if the snap-on back isn't first automatically released by the pull. And whenever it says in this application and in the claims that the snap-on back automatically releases from the post when the post is pulled, it means, of course, that the snap-on back automatically releases from the post if the ornament is pulled and if the ornament isn't first automatically released from the post by the pull.

Posts of several different lengths are provided to accommodate ear lobes of different sizes, and posts of a few different widths are provided to accommodate pierced holes of different widths; thus a post of the correct length and width can be selected for each pierced hole. Therefore, the snap-on back and the stop are always positioned correctly against the ear lobe, not too loose and not too tight, by simply snapping the snap-on back on the small male snap connector portion at the end of the post.

Instead of being slightly rounded, the end of the post that is the small male snap connector portion for a snap-on back may be sharply pointed for use with an ear piercing machine to pierce ears.

The objects and advantages stated above as well as many other objects and advantages of the present invention will become apparent to those of ordinary skill in the art after having read the following detailed description of the preferred embodiments illustrated in the several figures of drawings.

BRIEF DESCRIPTION OF THE DRAWINGS

FIG. 4 is a longitudinal sectional view of another embodiment with an ornament having the clamp portion of a clamp connector;

FIG. 5 is an exploded perspective view showing a slightly modified embodiment of the invention;

FIG. 6 is a longitudinal sectional view thereof taken along line 6—6 of FIG. 5 showing the earring assembled in position in the pierced hole;

FIG. 7 is a longitudinal sectional view of an alternative embodiment, with the ornament unconnected;

FIG. 8 is a longitudinal sectional view of an alternative embodiment, with one ornament unconnected and one ornament connected; and FIG. 9 is a longitudinal sectional view of an alternative embodiment, with the ornaments connected.

DESCRIPTION OF THE PREFERRED EMBODIMENTS

Figure 1:
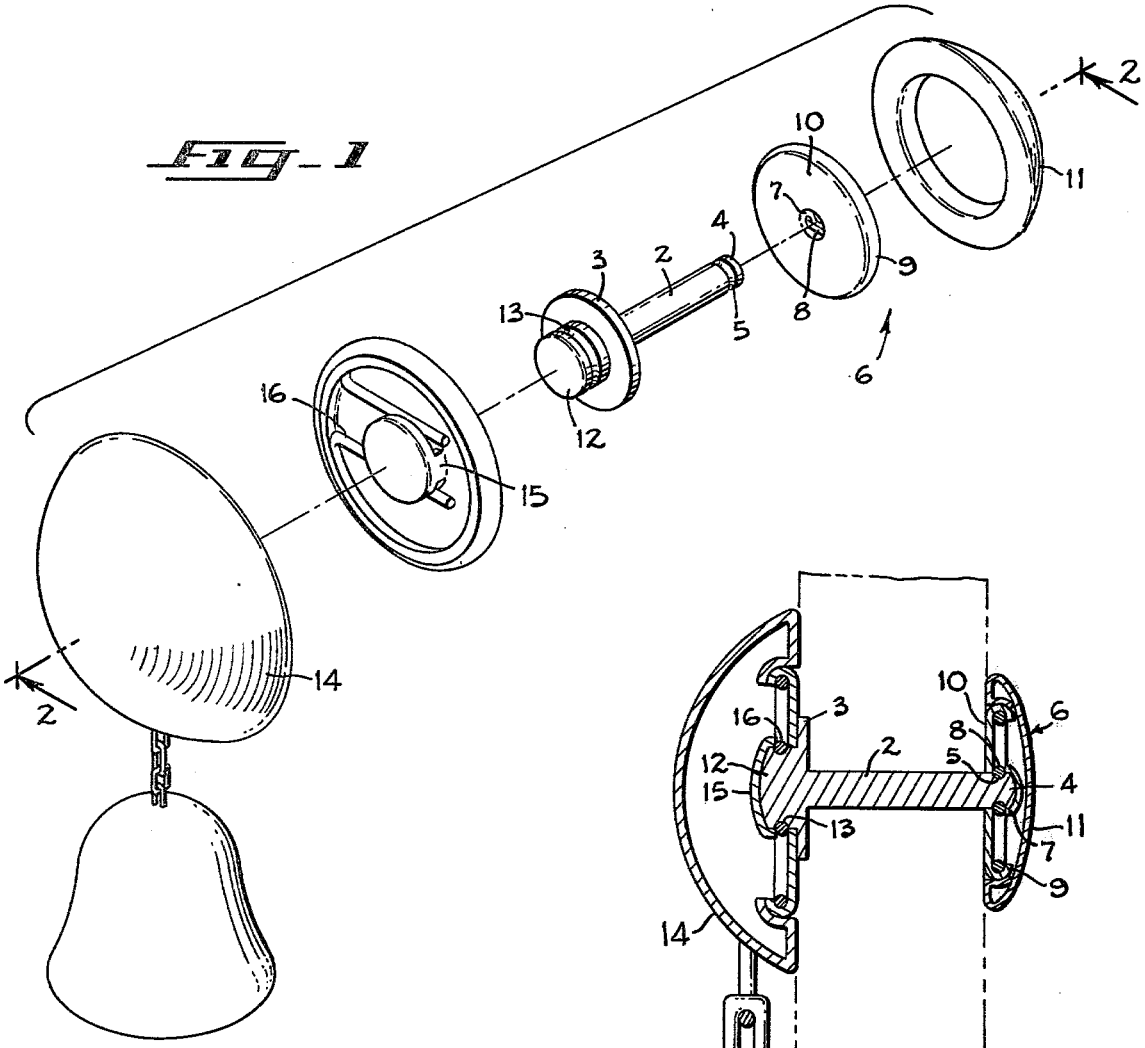
FIG. 1 is an exploded perspective view of an earring embodying the invention.
Figure 2:
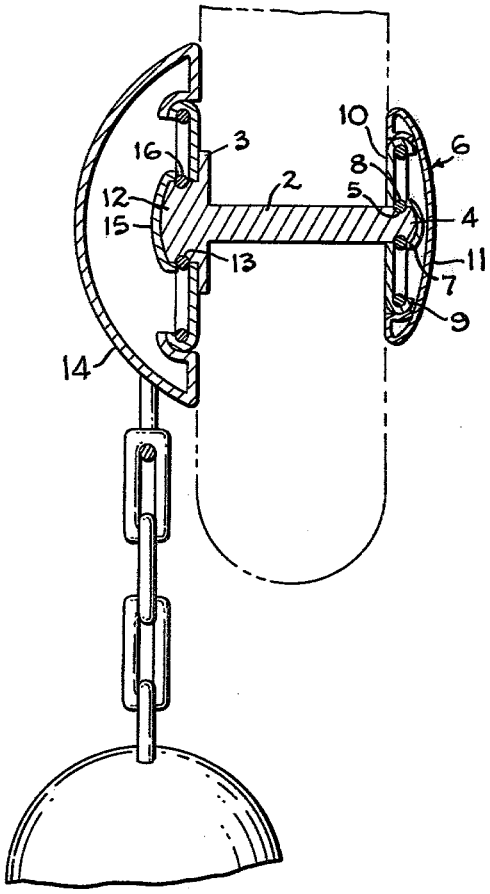
FIG. 2 is a longitudinal sectional view thereof taken along the line 2—2 of FIG. 1, showing the earring assembled in position in the ear lobe.

Referring now to FIGS. 1 and 2 of the drawings, all of the embodiments of the present invention depicted in all of the drawings may have in common the features described in the following long paragraph, however they all also have other additional or substitute features not described in the following paragraph.

All embodiments depicted in the drawings have a straight, round post 2 to insert into a pierced hole in an ear lobe. The post 2 is properly made of surgical steel or other hypo-allergenic material and extends through the pierced hole in an ear lobe. One end of the post 2 includes a small, relatively flat, circular stop 3 to prevent the post 2 from passing completely through the pierced hole. The side of the stop 3 that has the post 2 has a flat and smooth surface around the post 2, has the post 2 in the center thereof, is at right angles to the post 2, is properly made of surgical steel or other hypo-allergenic material, has a diameter sufficient to prevent the stop 3 from entering the pierced hole and is positioned flat against one surface of the ear lobe. The opposite side of the stop 3, the exposed side, has a connector portion so that interchangeable ornaments may be connected to the post 2. Various embodiments provide for different types of connector portions for ornaments. The several figures of drawings illustrate snap, magnetic, Velcro and clamp connector portions, and they will be specifically described in the following paragraphs. When the stop 3 is in position flat against the surface of the ear lobe, the stop 3 and the stop's connector portion of all embodiments shown in all of the several figures of drawings protrude less than three millimeters from the surface of the ear lobe, have no slender, jutting and rigid projections, have no exposed sharp points or edges that could cut or snag, have nothing that is likely to be accidentally caught in or on anything and be pulled and have a surface and contour that is sufficiently smooth and even to avert snagging. Therefore, the stop 3 and the stop's connector portion of all embodiments are essentially nonsnaggy when in position against one surface of the ear lobe. The opposite end of the post 2 is slightly rounded and is a small male snap connector portion 4. Included as part of the small male snap connector portion 4 is a small groove 5 around the post 2 next to the end. The post 2 is of such length that the small male snap connector portion 4 can just pass completely through the pierced hole. To safely retain the post 2 in the pierced hole, a snap-on back 6 is provided. The snap-on back 6 is small, circular and relatively flat and has permanently within the snap-on back 6 a small female snap connector portion 7 that snaps on the small male snap connector portion 4 on the end of the post 2 to hold the snap-on back 6 on the post 2 during normal activity. If the end of the post 2 that has the stop 3 is pulled and/or if the snap-on back 6 is pulled, the snap-on back 6 automatically releases from the post 2 to prevent injury to the ear lobe. The small female snap connector portion 7 within the snap-on back 6 is formed by a thin disc with a cavity in the center thereof to fit over the small male snap connector portion 4 at the end of the post 2. The cavity is slotted so that the sides of a thin wire spring 8 resting therein can engage the small groove 5 of the small male snap connector portion 4. The thin wire spring 8 is held in place by the slots and also by a lip 9 around the outer edge of the disc. Instead of the type shown in FIGS. 1 and 2, other types of female snap connector portions may be used to engage the groove 5 of the small male snap connector portion 4. The words "snap connector" whenever used in the claims refer not only to the types of snap connectors shown in all of the drawings, but also to other similar types of small friction connectors that have a male portion and a female portion to engage together, but which do not necessarily have to engage and disengage with a clicking sound. One side 10 of the snap-on back 6 has the entrance of the cavity of the female snap connector portion 7, has a substantially flat and smooth surface around the entrance, is properly made of surgical steel or other hypo-allergenic material, has a diameter sufficient to prevent the snap-on back 6 from entering the pierced hole and is positioned flat against the other surface of the ear lobe to retain the post 2 in the pierced hole when the snap-on back 6 is attached. The opposite side of the snap-on back 6 is the exposed side 11. The exposed side 11 of the snap-on back 6 has a solid, smooth and substantially flat surface. The exposed side 11 of the snap-on back 6 and/or the rear of the cavity of the female snap connector portion 7 within the snap-on back 6 includes a barrier that prevents the end of the post 2 from protruding through the snap-on back 6. Also the barrier does not allow the snap-on back 6 to be pushed along the post 2 further than the very short distance that is required to secure the snap-on back 6 to the small male snap connector portion 4 at the end of the post 2. The barrier also prevents the snap-on back 6 from being pushed too tightly against the ear lobe. The basic snap-on back 6, which may be used with any embodiment, has a plano-convex shape, the convex side being the exposed side 11 of the snap-on back 6, which is substantially flat. Additionally, the exposed side 11 of the snap-on back 6 may have a special connector portion for connecting interchangeable ornaments to the snap-on back 6. The several figures of drawings illustrate snap-on backs with snap, magnetic, Velcro and clamp connector portions for ornaments, and they will be specifically described in the following paragraphs. When either the basic snap-on back 6 or a snap-on back with a connector portion for ornaments is in position flat against the surface of the ear lobe, the snap-on back protrudes less than three millimeters from the surface of the ear lobe, has no slender, jutting and rigid projection, has no exposed sharp point or edge that could cut or snag, has nothing that is likely to be accidentally caught in or on anything and be pulled and has a surface and contour that is sufficiently smooth and even to avert snagging. Therefore, both the basic snap-on back 6 and the snap-on back with a special connector portion for ornaments are essentially nonsnaggy when in position against the surface of the ear lobe. When the post 2 is the correct length, the stop 3 and the snap-on back 6 each rest flat against one of the two surfaces of the ear lobe without pinching or squeezing the ear lobe and with no gap between the ear lobe and the stop 3 and with no gap between the ear lobe and the snap-on back 6. Therefore, all embodiments shown in the several figures of drawings are essentially nonsnaggy when in position in the pierced hole without an ornament attached. Also, when worn with no ornament attached, neither the front nor the rear of any embodiment shown in the drawings is likely to poke, scratch and/or irritate the wearer or another. All embodiments provide a great number of interchangeable ornaments all of which are very easily connected and disconnected without removing the post 2 from the pierced hole and without looking in a mirror. All embodiments provide that the ornaments are securely held to the post 2 during normal activity, but whenever an ornament is pulled, the ornament automatically releases from the post 2 to prevent injury to the ear lobe. The descriptions in this paragraph refer generally to all of the embodiments depicted in all of the drawings.

FIGS. 1 and 2 specifically illustrate an embodiment with a small, nonsnaggy male portion 12 of a snap connector incorporated in the center of the exposed side of the stop 3. The small, nonsnaggy male portion 12 has a solid, smooth surface and has a slight groove 13 around its perimetrical surface. The exposed surface of the stop 3 and the small, nonsnaggy male portion 12 incorporated therewith may be made of surgical steel, gold, plastic or other suitable material and be ornamental in appearance. A pendant ornament 14 is permanently attached to a female portion 15 of a snap connector. The female portion 15 of the snap connector included as part of the ornament 14 is the same type as the female snap connector portion 7 within the snap-on back 6. The sides of the thin wire spring 16 of the female portion 15 engage the slight groove 13 of the small, nonsnaggy male portion 12 to hold the ornament 14 to the post 2 during normal activity, but whenever the ornament 14 is pulled, the female portion 15 automatically releases from the small, nonsnaggy male portion 12 to freely release the ornament 14 from the post 2 to prevent the ear lobe from being torn.

Figure 3:
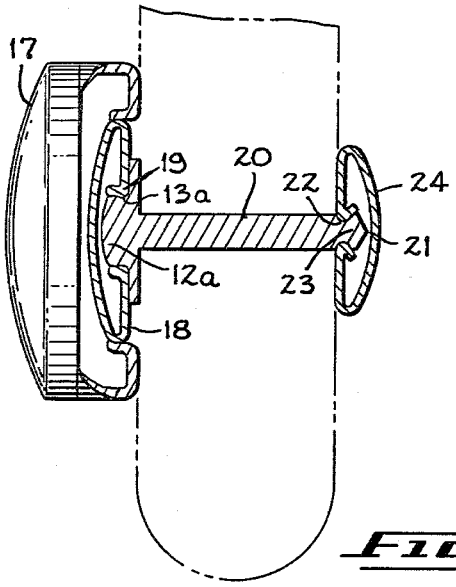
FIG. 3 is a longitudinal sectional view of a slightly modified embodiment with a piercing point.

FIG. 3 illustrates the same kind of stop's end as illustrated in FIGS. 1 and 2, in position in the pierced hole with a cabachon ornament 17 attached. The cabachon ornament 17 is permanently mounted on a female portion 18 of the snap connector, which female portion 18 contains a resilient circular lip 19 which is notched to allow expansion and is designed to engage directly the slight groove **13*a* of the small, nonsnaggy male portion 12*a* of the snap connector and thus eliminate the need for a wire spring in the female portion 18** of the snap connector. A resilient circular lip without notches could be used instead of one which is notched.

FIG. 3 also illustrates an ear piercing post 20 to be used with an ear piercing machine to pierce ears. Instead of a slightly rounded end, the very extremity of the snap-on back's end of the piercing post 20 is a sharp point 21 which is formed adjacent to the small groove 22 of the small male snap connector portion 23 at the end of the piercing post 20. The ear piercing machine forces the sharp point 21 and the small male snap connector portion 23 completely through an ear lobe to pierce a hole in the ear lobe. A snap-on back 24 snaps on the small male snap connector portion 23 and is properly positioned flat against the rear surface of the ear lobe. If a nonpiercing post is mistakenly selected that is not the correct length, it is a simple matter to substitute another post that is the correct length. But if a piercing post is mistakenly selected that is too short for the particular ear lobe, it is not so easy to correct the mistake because the piercing post should normally not be removed from the ear lobe for several weeks after the ear lobe is newly pierced. Therefore, a special micrometer should be used to measure the thickness of the ear lobe where the pierced hole is to be made so that a piercing post 20 of the correct length is selected. If a piercing post is selected that is too long, a disc-shaped pad which is the same width as the snap-on back 24, which is made of soft compressible material and which has a perpendicular hole in its center for the piercing post 20 to fit through is placed on the piercing post 20 between the snap-on back 24 and the rear of the ear lobe and is designed to compensate for the piercing post 20 being longer than proves to be necessary, by filling the gap with the soft comforting pad. All of the other embodiments illustrated in the following figures of drawings may similarly also have a sharp point at the very extremity of the snap-on back's end of the post and be used with an ear piercing machine to pierce ears.

FIG. 4 illustrates a post **2*b* and a snap-on back 6*b* similar to those shown in FIGS. 1 and 2. The post 2*b* includes at one end a stop 3*b* and a small, nonsnaggy male portion 12*b* of a snap connector. The sides of the thin wire spring 8*b* of the female snap connector portion 7*b* within the snap-on back 6*b* engage the small groove 5*b* of the small male snap connector portion 4*b* at the opposite end of the post 2*b* to hold the snap-on back 6*b* on the small male snap connector portion 4*b* during normal activity to retain the post 2*b* in the pierced hole, but if the snap-on back 6*b* or the post 2*b* is pulled, to automatically release the snap-on back 6*b* from the post 2*b* to prevent the ear lobe from being torn. An interchangeable ornament containing a mating female portion of a snap connector may be snapped on the slight groove 13*b* of the small, nonsnaggy male portion 12*b* as shown in FIGS. 1, 2 and 3**.

FIG. 4 illustrates, however, another embodiment in which a clamp-on ornament 25 includes the clamp portion of a clamp connector that clamps at the same time against both the stop's end of the post **2*b* and against the snap-on back 6*b* on the opposite end of the post 2*b*. The front connector portion 26 of one half of the clamp pushes against the end of the small, nonsnaggy male portion 12*b* at the stop's end of the post 2*b*, while the rear connector portion 27 of the other half of the clamp pushes against the exposed surface of the snap-on back 6*b*. The clamp-on ornament 25 has a small spring 28 hat is attached to the rear connector portion 27 and that supplies the pressure to keep the clamp-on ornament 25 clamped on the post 2*b* during normal activity. The end of the small, nonsnaggy male portion 12*b* receives and supports the front connector portion 26** of the clamp, while the exposed surface of the snap-on back *6b*, which is convex-shaped, receives and supports the rear connector portion 27 of the clamp. Both the front connector portion 26 and the rear connector portion 27 have similiar smooth, saucer-shaped surfaces that simultaneously push against the receiving and supporting portions on the opposite ends of the post *2b* and that automatically slide off the receiving and supporting portions whenever the clamp-on ornament 25 is pulled. The clamp-on ornament 25 could be very rigid to prevent the clamp from being squeezed together tighter whenever the clamp-on ornament 25 is grabbed and pulled. The clamp-on ornament 25 shown, however, does not need to be very rigid, because there is a hinge between the ornament 25 and the rear connector portion 27 that automatically causes the rear connector portion 27 to be forced to the rear and off the snap-on back *6b* whenever the clamp-on ornament 25 is squeezed together as it is pulled. The receiving and supporting portions are nonsnaggy; therefore the clamp portion can not get caught in the receiving and supporting portions; and therefore whenever the ornament 25 is pulled, the ornament 25 automatically releases from the post *6b* to prevent injury to the ear lobe.

All of the other embodiments depicted in the other figures of drawings may receive and support clamp-on ornaments in a similar manner. Clamp-on earrings of the prior art that clamp against the ear lobe, pinch the ear lobe; whereas clamp-on ornaments of the present invention, that clamp against the stop's end of the post *2b* and against the snap-on back *6b* at the opposite end of the post *2b*, do not pinch the ear lobe.

FIGS. 5 and 6 illustrate a slightly modified embodiment in which the stop 29 has a slight groove 30 around its perimetrical surface and serves as a wider nonsnaggy male portion 31 of a snap connector. The exposed surface of the stop 29, which is a wider nonsnaggy male portion 31 of a snag connector, may be made of surgical steel, gold or other material and be ornamental in appearance. In fact, a beautiful, small, polished precious or semiprecious stone may be mounted within the wider nonsnaggy male portion 31 in such a manner that the stop 29 and its male portion 31 would nevertheless remain essentially nonsnaggy when in position against the surface of the ear lobe. A heart-shaped ornament 32 includes a female portion of the snap connector which has a cavity 33 with a recess 34 therein, and the recess 34 holds a C-shaped spring 35 designed to engage the slight groove 30 around the nonsnaggy male portion 31 of the snap connector. The female portion within the heart-shaped ornament 32 also includes a thin pad 37 to make contact with the front surface of the wider nonsnaggy male portion 31 to provide friction to prevent the ornament 32 from rotating to maintain the heart-shaped ornament 32 in the desired orientation. This could also be accomplished by another means such as a coating that increases the friction. Although a female portion with added friction may be desirable for some ornaments, it would be undesirable for most ornaments, since it would usually increase the risk of the ornament being snagged. Whenever an ornament 32 with a female portion of a snap connector with added friction is snagged and pulled, the ornament 32 nevertheless automatically releases from the post 36 and thus prevents the ear lobe from being cut and/or torn. Also shown is a snap-on back 38 with a female snap connector portion therein which has a cavity with a recess 39 therein and the recess 39 holds a small c-shaped spring 40 to engage the small groove 41 of the small male snap connector portion 42 at the end of the post 36, to hold the snap-on back 38 to the post 36 during normal activity, but if the end of the post 36 that has the stop 29 is pulled and/or if the snap-on back 38 is pulled, to automatically release the snap-on back 38 from the post 36 to protect the ear lobe from injury. The snap-on back 38 also has a slight groove 43 around its perimetrical surface and also serves as a wider nonsnaggy male portion of a snap connector. The snap-on back 38 is similar in size and shape to the stop 29 and its nonsnaggy male portion 31 of a snap connector. A female portion 44 of a snap connector has a circular resilient lip 45 that engages the slight annular groove 43 around the wider nonsnaggy male portion incorporated as part of the snap-on back 38. A pendant ornament 46 is permanently attached to the female portion 44, which is ornamental in appearance. The female portion 44 can also couplingly engage the slight annular groove 30 around the stop's nonsnaggy male portion 31. And the heart-shaped ornament 32 can also couplingly engage the slight annular groove 43 of the wider nonsnaggy male portion incorporated as part of the snap-on back 38. Both ends of the earring are essentially nonsnaggy when worn with no ornament attached. The snap connectors are designed to hold interchangeable ornaments 32 and 46 to the stop 29 and/or to the snap-on back 38 during normal activity, but whenever an ornament 32 or 46 is pulled, to automatically release the ornament 32 or 46 including its female portion to prevent injury to the ear lobe.

The slight annular groove 30 around the nonsnaggy male portion 31 of the stop 29 may be described instead as two slight annular enlargements around the perimetrical surface of the nonsnaggy male portion 31 of the stop 29. The slight enlargement closer to the ear lobe is not necessary for the female portion to engage the male portion, and this slight enlargement may be eliminated, and then there would be an annular half of a groove around the male portion for the female portion to engage. Therefore, a complete groove is not needed; instead, there may be only an annular half of groove or enlargement around the perimetrical surface of the nonsnaggy male portion 31 of the stop 29 and also around the perimetrical surface of the snap-on back 38 to engage with the female portions. The enlargement may be resilient. Reference is hereby made to another U.S. patent application of your petitioner, Gordon A. Johnson, which other application will be field at the same time as this present application and which other application prays that letters patent be granted Gordon A. Johnson for the improvement in "EARRINGS THAT DISPLAY NATURAL FLOWERS AND OTHER EMBELLISHMENTS". Another example of an earring provided by the present invention is shown in FIGS. 1 and 2 of said other application, which figures of drawings show a "Safety Earring for Pierced Ears" of the present invention which has a nonsnaggy male portion that has an annular half of a groove around its perimetrical surface for the female portion to engage, which annular half of a groove is formed by a slight enlargement around the perimetrical surface of the nonsnaggy male portion.

FIG. 7 illustrates an alternative embodiment in which a small female portion 47 of a snap connector is incorporated in the center of the stop 48. The small female portion 47 has a cavity with an annular recess 49 therein which holds a small c-shaped spring 50. An ornament 51 is permanently attached to a small male portion 52 of a snap connector that couplingly mates with the female portion 47 by the small male portion 52 being inserted into the small female portion 47 the very short distance that is required for the small c-shaped spring 50 to engage around the slight groove 53 around the perimetrical surface of the small male portion 52. Also shown is a snap-on back 54, one side of which has the entrance of the female snap connector portion which has a recess 55 therein which holds a small c-shaped spring 56 which couplingly engages around the small groove 57 around the small male snap connector portion 58 at the snap-on back's end of the post 59 to hold the snap-on back 54 to the post 59 during normal activity, but when the snap-on back 54 and/or the post 59 is pulled, to automatically release the snap-on back 54 from the post 59 to prevent injury to the ear lobe. The opposite side of the snap-on back 54 has the circular entrance of a small female portion 60 of a snap connector, which female portion 60 has an annular recess 61 therein which holds a small c-shaped spring 62 to couplingly engage around the slight groove 53 around the small male portion 52. The small c-shaped springs 50, 56 and 62 have ellipsoidal cross sections, and the major axis of each ellipse is perpendicular to the post 59 to retain the small c-shaped springs 50, 56 and 62 in their recesses 49, 55 and 61, and thereby enable the stop 48 and the snap-on back 54 to be even less protrusive than if the small c-shaped springs 50, 56 and 62 had round cross sections. The small male portion 52, or a small male portion of an interchangeable ornament, may alternatively couplingly mate with either of the small female portions 47 or 60 to hold the ornament 51 to the post 59 or to the snap-on back 54 during normal activity, but whenever the ornament 51 is pulled, to automatically release the ornament 51 from the post 59 or from the snap-on back 54 to prevent injury to the ear lobe. Instead of a groove, the small male portion 52 may have an annular half of a groove or a flange, which may be resilient, to engage the female portions 47 and 60.

FIG. 8 depicts another embodiment in which the entire post 63 including the stop 64 is a magnet. Otherwise, the post 63 is not a magnet but a magnet is incorporated in the stop 64. A half sphere ornament 65 is shown which contains magnetically attractable material 66, which material may be another magnet with an exposed surface of a polarity opposite the polarity of the exposed surface of the stop 64. Or the stop 64 may not be a magnet, but may be made of magnetically attractable material, and the ornament 65 would contain the magnet 66. The half sphere ornament 65 is shown unconnected to the earring. However, the magnetic field is such that the ornament 65 is attracted to the stop 64 and is securely held to the stop 64 during normal activity, but whenever the ornament 65 is pulled, the ornament 65 automatically releases from the post 63 to prevent injury to the ear lobe. The ornament 65 has a small lip 67 that fits over the edge of the stop 64 to prevent the ornament 65 from sliding off center. The snap-on back 68 also contains a magnet or is made of magnetically attractable material and couplingly mates with an ornament 69 in the same manner. The ornament 69 is shown connected to the snap-on back 68. The ornament 69 contains a magnet 70 or magnetically attractable material 70, and the ornament 69 could be disconnected from the snap-on back 68 and connected to the stop 64. And the half sphere ornament 65 could be connected to the snap-on back 68 in the same manner.

FIG. 9 shows another embodiment in which a post 71 has as the surface of the exposed side of the stop 72 the smoother and softer portion 73 of a Velcro type fastener. The snap-on back 74 also has as the surface of its exposed side the smoother and softer portion 75 of a Velcro type fastener. Also shown are interchangeable ornaments 76 and 77 each with the mating portion 78 and 79 of the Velcro type fastener permanently attached thereto. Each of the ornaments 76 and 77 has a small lip 80 and 81 that fits over the edge of the smoother and softer portions 73 and 75 to make it easier to connect the Velcro type fasteners properly and to conceal the Velcro type connectors from view. The Velcro type fasteners are designed to hold the ornaments 76 and 77 to the stop 72 or snap-on back 74 during normal activity but whenever an ornament 76 or 77 is pulled, to automatically release the ornament 76 or 77 to prevent injury to the ear lobe.

It is contemplated that after having read the preceding disclosures, certain alterations and modifications of the present invention will no doubt become apparent to those skilled in the art, and consequently it is intended that the following claims be interpreted to cover all such alterations and modifications as fall within the true spirit and scope of the invention.

What is claimed is:

1. A safety earring for pierced ears which comprises a cylindrical post adapted to extend through the pierced hole in an ear lobe, and including at one end of said post a stop having an ear lobe facing side and said ear lobe facing side of said stop has a substantially flat and smooth surface surrounding said post with said post extending perpendicularly from the center of said ear lobe facing side of said stop and wherein said ear lobe facing side of said stop is laterally dimensioned larger than said post and larger than the pierced hole to prevent said stop from entering the pierced hole and is adapted to be positioned flat against one surface of the ear lobe, and a first connector portion for couplingly mating with an ornament, and including at the opposite end of said post a second connector portion for couplingly mating with a back;

a back for detachable connection with said second connector portion, wherein said back includes a third connector portion for couplingly mating with said second connector portion to hold said back to said post, said back being laterally dimensioned larger than said post and larger than the pierced hole to prevent said back from entering the pierced hole and is adapted to be positioned against the other surface of the ear lobe to retain said post in the pierced hole; and an ornament for easy detachable connection with said first connector portion, wherein said ornament includes a fourth connector portion for couplingly mating with said first connector portion to hold said ornament to said post during normal activity, and wherein said fourth and first connector portions are automatically operable to release said fourth connector portion from said first connector portion whenever there is excessive tension between said fourth and first connector portions from a force acting on said fourth connector portion in a direction relatively away from said cylindrical post and relatively away from the ear lobe, whereby said ornament is freely released from said post and said tension between said fourth and first connector portions is eliminated to protect the ear lobe from injury, and whereby said ornament may be easily connected to and disconnected from said post by the wearer without removing said post from the pierced hole and without looking in a mirror; and wherein said stop and said first connector portion together are laterally dimensioned no larger than approximately 6 millimeters and are longitudinally dimensioned no larger than approximately 3.5 millimeters, and wherein the perimetrical surface of said stop and of said first connector portion is at least somewhat smooth and is solid in the sense that said perimetrical surface of said stop and of said first connector portion has no hole or opening; thereby protecting against said ornament staying undesirably caught in said first connector portion whenever said fourth connector portion is pulled, and thereby protecting against anything else being accidentally caught in said first connector portion, thus the ear lobe is protected from injury and thus said back and said post are protected from needless accidental detachment and consequential loss.

2. An earring as recited in claim 1 wherein said first connector portion includes the male portion of a snap connector and said male portion includes means for couplingly mating with said fourth connector portion; and wherein said fourth connector portion includes a female portion of said snap connector and said female portion includes means for couplingly engaging said male portion.

3. An earring as recited in claim 2 wherein the entire surface of said male portion is solid in the sense that said surface has no hole or opening, wherein said male portion is laterally dimensioned more than twice as large as the diameter of said cylindrical post, and wherein the very end of said male portion has a surface that is at least somewhat flat and smooth and that is faced in the direction opposite to said ear lobe facing side of said stop; thereby further protecting against anything being accidentally caught in said male portion, whereby the ear lobe is protected from injury and whereby said back and said post are protected from needless accidental detachment and consequential loss, and thereby further protecting the side of the wearer's head from harm when said male portion is pressed against the side of the wearer's head; and wherein said male portion has a small enlargement around its perimetrical surface and said female portion has means for couplingly engaging said small enlargement.

4. An earring as recited in claim 1 wherein said first connector portion includes the female portion of a snap connector and said female portion includes means for couplingly mating with said fourth connector portion; and wherein said fourth connector portion includes a male portion of said snap connector and said male portion includes means for couplingly engaging said female portion.

5. An earring as recited in claim 4 wherein said male portion has a small enlargement around its perimetrical surface, and wherein said female portion has resilient means, for couplingly engaging said small enlargement.

6. An earring as recited in claim 1 wherein said first connector portion includes a magnet; and wherein said fourth connector portion includes magnetically attractable material.

7. An earring as recited in claim 1 wherein said first connector portion includes magnetically attractable material; and wherein said fourth connector portion includes a magnet.

8. An earring as recited in claim 1 wherein said second connector portion includes a male snap connector portion that is adapted to pass completely through the pierced hole and wherein said male snap connector portion includes a groove around its perimetrical surface;

wherein said third connector portion includes a female snap connector portion within said back and said female snap connector portion includes means for couplingly engaging said groove of said male snap connector portion to hold said back to said post during normal activity to retain said post in the pierced hole, and said female and male snap connector portions are automatically operable to release said female snap connector portion from said male snap connector portion when there is excessive tension between said back and said post from a force acting on said back in a direction relatively away from said cylindrical post, whereby said back is freely released from said post and said tension between said back and said post is eliminated to protect the ear lobe from injury;

wherein said back has an ear lobe facing side, and said ear lobe facing side of said back has the entrance of said female snap connector portion, has a substantially flat and smooth surface surrounding said entrance, is laterally dimensioned larger than said post and larger than the pierced hole to prevent said ear lobe facing side of said back from entering the pierced hole and is adapted to be positioned flat against the other surfaces of the ear lobe to retain said post in the pierced hole;

wherein said back has an opposite side, and said opposite side of said back includes a barrier that prevents said opposite end of said post from protruding through said back thereby protecting against said opposite end of said post poking the wearer, and wherein the surface of said opposite side of said back is at least somewhat flat and smooth;

wherein the perimetrical surface of said back is at least somewhat smooth and is solid in the sense that said perimetrical surface of said back has no hole or opening; and wherein said back is laterally dimensioned no larger than approximately 7 millimeters and is longitudinally dimensioned no larger than approximately 3.5 millimeters;

thereby protecting against anything being accidentally caught in said back, thus the ear lobe is protected from injury and thus said back and said post are protected from needless accidental detachment and consequential loss; whereby the side of the wearer's head is protected from harm when said back is pressed against the side of the wearer's head; whereby the ear lobe is protected from said back being pushed on too tightly and pinching the ear lobe; whereby the length of said post is no longer than necessary, thus protecting the ear lobe from injury; and whereby said back facilitates connecting said ornament to and disconnecting said ornament from said first connector portion.

9. An earring as recited in claim 8 wherein said first connector portion includes the male portion of a snap connector and said first connector portion's male portion of a snap connector includes means for couplingly mating with said fourth connector portion; and wherein said fourth connector portion includes a female portion of said snap connector and said fourth connector portion's female portion of said snap connector includes means for couplingly engaging said first connector portion's male portion of a snap connector.

10. An earring as recited in claim 9 wherein the entire surface of said first connector portion's male portion of a snap connector is solid in the sense that said surface has no hole or opening, wherein said first connector portion's male portion of a snap connector is laterally dimensioned more than twice as large as the diameter of said cylindrical post, and wherein the very end of said first connector portion's male portion of a snap connector has a surface that is at least somewhat flat and smooth and that is faced in the direction opposite to said ear lobe facing side of said stop; thereby further protecting against anything being accidentally caught in said first connector portion's male portion of a snap connector, whereby the ear lobe is protected from injury and whereby said back and said post are protected from needless accidental detachment and consequential loss, and thereby further protecting the side of the wearer's head from harm when said first connector portion's male portion of a snap connector is pressed against the side of the wearer's head; and wherein said first connector portion's male portion of a snap connector has a small enlargement around its perimetrical surface and said fourth connector portion's female portion of said snap connector has means for couplingly engaging said small enlargement.

11. An earring as recited in claim 8 wherein said first connector portion includes the female portion of a snap connector and said first connector portion's female portion of a snap connector includes means for couplingly mating with said fourth connector portion; and wherein said fourth connector portion includes a male portion of said snap connector and said fourth connector portion's male portion of said snap connector includes means for couplingly engaging said first connector portion's female portion of a snap connector.

12. An earring as recited in claim 11 wherein said fourth connector portion's male portion of said snap connector has a small enlargement around its perimetrical surface, and wherein said first connector portion's female portion of a snap connector has resilient means for couplingly engaging said small enlargement.

13. An earring as recited in claim 8 wherein said first connector portion includes a magnet; and wherein said fourth connector portion includes magnetically attractable material.

14. An earring as recited in claim 8 wherein said first connector portion includes magnetically attractable material; and wherein said fourth connector portion includes a magnet.

15. An earring as recited in claim 8 wherein said back further includes a fifth connector portion for couplingly mating with said fourth connector portion; and wherein said fourth connector portion is capable of alternatively mating with said fifth connector portion to hold said ornament to said back during normal activity, and wherein said fourth and fifth connector portions are automatically operable to release said fourth connector portion from said fifth connector portion when there is excessive tension between said fourth and fifth connector portions from a force acting on said fourth connector portion in a direction relatively away from said cylindrical post and relatively away from the ear lobe, whereby said ornament is freely released from said back and said tension between said fourth and fifth connector portions is eliminated to protect the ear lobe from injury.

16. An earring as recited in claim 15 wherein said first connector portion includes the male portion of a snap connector and said first connector portion's male portion of a snap connector includes means for couplingly mating with said fourth connector portion;

wherein said fifth connector portion includes the male portion of a snap connector and said fifth connector portion's male portion of a snap connector includes means for coupling mating with said fourth connector portion; and wherein said fourth connector portion includes a female portion of a snap connector for alternatively couplingly engaging either said first connector portion's male portion of a snap connector or said fifth connector portion's male portion of a snap connector.

17. An earring as recited in claim 15 wherein said first connector portion includes the female portion of a snap connector and said first connector portion's female portion of a snap connector includes means for couplingly mating with said fourth connector portion;

wherein said fifth connector portion includes the female portion of a snap connector and said fifth connector portion's female portion of a snap connector includes means for couplingly mating with said fourth connector portion; and wherein said fourth connector portion includes a male portion of a snap connector for alternatively coupling engaging either said first connector portion's female portion of a snap connector or said fifth connector portion's female portion of a snap connector.

18. An earring as recited in claim 15 wherein said first connector portion includes a magnet;

wherein said fifth connector portion includes a magnet; and wherein said fourth connector portion includes magnetically attractable material.

19. An earring as recited in claim 15 wherein said first connector portion includes magnetically attractable material;

wherein said fifth connector portion includes magnetically attractable material; and wherein said fourth connector portion includes a magnet.

20. An earring as recited in claim 8 wherein said back includes a fifth connector portion for coupling mating with said fourth connector portion; and wherein said fourth connector portion includes a clamp with means to push against said first connector portion and with means to simultaneously clampingly push against said fifth connector portion to hold said ornament to said post and to said back during normal activity, and wherein said first, fourth and fifth connector portions and automatically operable to release said fourth connector portion from said first and fifth connector portions whenever there is excessive tension between said fourth and first connector portions from a force acting on said fourth connector portion in a direction relatively away from said cylindrical post and relatively away from the ear lobe, whereby said ornament is freely released from said post and from said back and said tension is eliminated to protect the ear lobe from injury;

wherein said first and fifth connector portions each include means for simultaneously receiving one half of said clamp, and wherein the surface of said first and fifth connector portions is solid in the sense that said surface of said first and fifth connector portions contains no hole or opening, thereby protecting against said fourth connector portion staying undesirably caught in said first or fifth connector portions and thereby protecting against anything else being accidentally caught in said first or fifth connector portions, thus the ear lobe is protected from injury; and whereby the ear lobe is protected from said clamp pinching the ear lobe.

* * * * *